United States Patent [19]

Kusumoto

[11] Patent Number: 4,857,957

[45] Date of Patent: Aug. 15, 1989

[54] IMAGE FORMING APPARATUS

[75] Inventor: Keiji Kusumoto, Osaka, Japan

[73] Assignee: Minolta Camera Kabushiki Kaisha, Osaka, Japan

[21] Appl. No.: 277,810

[22] Filed: Nov. 30, 1988

Related U.S. Application Data

[63] Continuation of Ser. No. 156,483, Feb. 16, 1988, abandoned.

[30] Foreign Application Priority Data

Feb. 17, 1987 [JP] Japan ..... 62-33707

[51] Int. Cl.[4] ..... G03G 15/06

[52] U.S. Cl. ..... 355/314; 355/245; 355/311

[58] Field of Search ..... 355/14 R, 14 D, 14 C, 355/14 SH, 3 DD, 3 SH, 4

[56] References Cited

U.S. PATENT DOCUMENTS 4,315,685 2/1982 Inuzuka et al. ..... 355/14 R
4,579,443 4/1986 Abuyama et al. ..... 355/14 C
4,615,609 10/1986 Honma ..... 355/14 R
4,633,405 12/1986 Ito et al. ..... 355/14 C
4,647,188 3/1987 Komiya et al. ..... 355/14 R

FOREIGN PATENT DOCUMENTS 60-232566 11/1985 Japan .

*Primary Examiner*—R. L. Moses
*Attorney, Agent, or Firm*—Burns, Doane, Swecker & Mathis

[57] ABSTRACT

The disclosure relates to an image forming apparatus capable of executing a copying operation by combining a plurality of copying conditions inclusive of at least a standard condition and a condition different from the standard condition. In the image forming apparatus, the designated condition is automatically returned to the standard condition after a lapse of predetermined time after the copying operation, but when any one of conditions different from the standard condition is entered during the copying operation, the entered condition is prohibited from being automatically returned to the standard condition or the predetermined time for automatically returning the designated condition to the standard condition is extended.

11 Claims, 16 Drawing Sheets

IMAGE FORMING APPARATUS

This application is a continuation of application Ser. No. 156,483, filed Feb. 16, 1988, now abandoned.

BACKGROUND OF THE INVENTION

1. Field of the Invention

The present invention relates to image forming apparatus such as electrophotographic copying machines and laser beam printers, and more particularly to a control system for an image forming apparatus having a plurality of developing units, cassettes or other means.

2. Description of the Prior Art

Recently, image forming apparatus such as electrophotographic copying machines, laser beam printers and the like have been proposed wherein a plurality of paper feed cassettes are provided for accommodating copy paper of different sizes, a plurality of developing units are arranged around the surface of an electrostatic latent image bearing member in the direction of movement of the member, or copying operation can be conducted under a plurality of copy modes.

Further image forming apparatus generally have the automatic reset function of resetting all the copy modes to the initial standard state unless an input is given from the operation panel within a predetermined period of time after the completion of an image forming operation. The term "auto-reset" as used herein means the above-mentioned automatic reset function.

On the other hand, image forming apparatus have been proposed wherein a device or copy mode other than the device or mode currently in use for image forming operation can be specified by an advance input during the image forming operation. However, in the case where the next user fails to promptly make preparations and initiate the subsequent image forming operation, the auto-reset function is performed before the subsequent operation even if he entered copying conditions, different from the current conditions, in advance during the current image forming operation. Consequently, the advance input becomes useless.

This problem is encountered, for example, with apparatus wherein one of a plurality of developing units is selectively operated for development. Unexamined Japanese Patent Publication SHO No. 60-232566 discloses such an apparatus which is adapted to accept an advance input specifying a particular developing unit during the current image forming operation and to effect a change-over from the developing unit in use to the specified one immediately after the completion of the current operation. The disclosed apparatus has the advantage that the time required for using the developing unit, different from the one currently used, for the next image forming operation can be reduced only to the time required for the change-over, thereby improving the work efficiency.

Nevertheless, if the auto-reset means functions before the next user starts the next image forming operation despite the advance input, there arises the problem that the above-mentioned advantage can not be utilized.

SUMMARY OF THE INVENTION

The main object of the present invention is to provide an image forming apparatus wherein when an advance input is given by a user during image forming operation to specify a device, set value or mode different from the one in current use, the advance input is precluded from cancellation even if the user fails to promptly start the subsequent image forming operation.

Another object of the invention is to provide an image forming apparatus which is adapted to accept during image forming operation an advance input sepcifying a device, set value or mode different from the one currently in use so as to promptly initiate the subsequent image forming operation.

These and other objects of the invention can be fulfilled by providing an image forming apparatus including image exposure means for projecting a document image on the surface of an electrostatic latent image bearing member to form an electrostatic latent image on the surface, developing means for developing the latent image and transfer means for transferring the developed image onto a transfer material to obtain a copy image, the image forming apparatus comprising first image forming means for forming images in a first copy mode, second image forming means for forming images in a second copy mode different from the first copy mode, auto-reset means for returning the second copy mode to the first copy mode a predetermined period of time after the completion of image forming operation in the second copy mode, input means for entering a second copy mode specifying input during image forming operation in the first copy mode, and control means at least adapted to prohibit the auto-reset means from returning the second copy mode to the first copy mode or to delay the return of the mode when the second copy mode specifying input is entered during image forming operation in the first copy mode.

BRIEF DESCRIPTION OF THE DRAWINGS

In the following description, like parts are designated by like reference numbers throughout the several drawings.

DESCRIPTION OF THE PREFERRED EMBODIMENTS

An image forming apparatus embodying the invention will be described below first with reference to FIGS. 1 to 11. The invention is embodied as an electrophotographic copying machine as will be described below. (Overall construction and operation of the copying machine, see FIG. 1)

Figure 1:
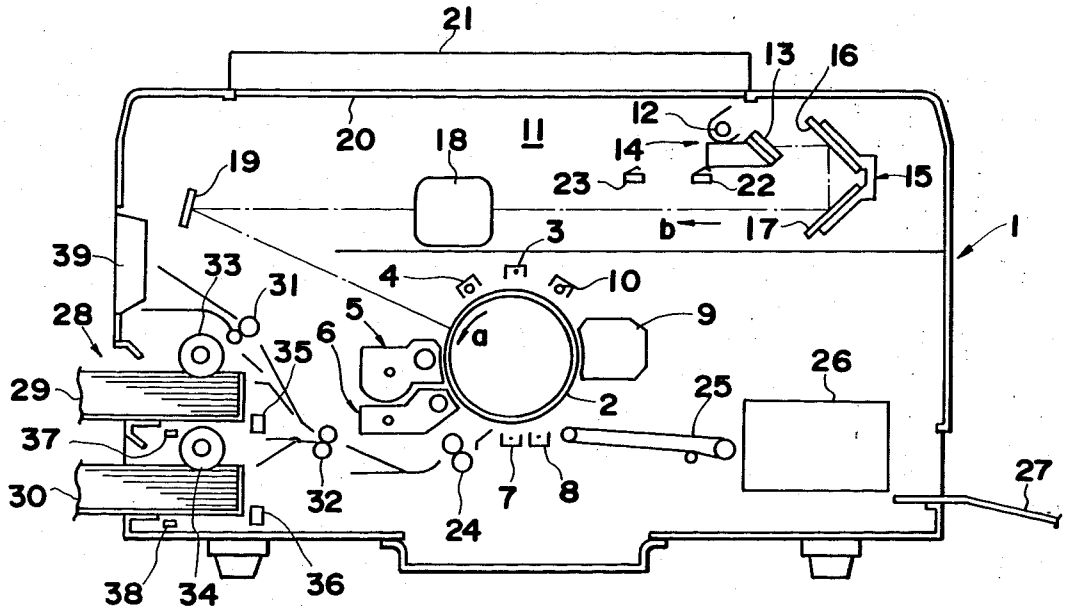
FIG. 1 is a front view showing the overall construction of a copying machine.

With reference to FIG. 1, a photosensitive drum 2 disposed approximately in the center of a copying machine main body 1 is drivingly rotatable by an unillustrated main motor in the direction of arrow a. Arranged around the drum 2 are a sensitizing charger 3, inter-image eraser 4, first and second developing units 5, 6 of the magnetic brush type, transfer charger 7, separating charger 8, cleaner 9 and main eraser 10. These components are arranged in the order mentioned in the direction of rotation of the drum 2 at a specified spacing. An optical system 11 is disposed above the drum 2 and these components. A paper feed assembly 28 is provided at the left side of FIG. 1, and a fixing unit 26 at the right side thereof. At least three developing units may be provided.

The optical system 11 is of the slit exposure type including mirrors for scanning. The system 11 comprises a scanning unit 14 including a light source 12 and a first movable mirror 13, another scanning unit 15 including second and third movable mirrors 16, 17, a lens 18 and a fixed mirror 19. The surface of the drum 2 is charged by the charger 3, for example, to a positive polarity, while the eraser 4 removes the charge from the inter-image area of the drum 2, i.e., from the area thereof other than the image forming area corresponding to the document held between a document support glass table 20 and a document holder 21. While the scanning units 14, 15 are being moved by an unillustrated scanning motor in the direction of arrow b with the light surce 12 turned on, an electrostatic latent image corresponding to the document image is formed on the drum surface.

The scanning unit 14 is moved at a velocity of V/m wherein V is the peripheral speed of the drum 2, and m is the magnification. The scanning unit 15 is moved at a velocity of V/2m. When the scanning unit 14 is in its home position, the unit is in pressing contact with a home position switch 22, which in turn feeds a home position signal (which is "1" when the unit 14 is thus positioned) to the first CPU 200 to be described later. To operate the paper feed assembly 28 as timed with the scanning unit 14, the unit comes into pressing contact with a timing switch 23 upon traveling a predetermined distance in the direction b after the start of scanning, whereupon the switch 23 delivers to the first CPU unit 200 a timing signal (which becomes "1" upon the contact of the unit 14 with the switch 23) for operating the pair of timing rollers 24 to be described later.

A negatively charged toner is deposited on the surface of the drum 2 by the first or second developing unit 5 or 6 which is selected for use, whereby the latent image is developed to a visible toner image corresponding to the document image.

On the other hand, copy paper is sent out from the feed assembly 28 and is fed to the surface of the drum 2 by the pair of timing rollers 24 in response to the timing signal, whereupon the toner image is transferred to the paper by the corona discharge of the transfer charger 7. Immediately thereafter the paper is separated from the drum surface by virtue of removal of the charge by an alternating electric field set up by the separating charger 8 and owing to the stiffness of the paper itself. The copy paper separated from the drum 2 is fed by a conveyor belt 25 to the fixing unit 26, has the toner image thermally fixed thereto and is delivered onto a tray 27.

The toner remaining on the drum surface is removed by the cleaner 9, and the residual charge on the drum surface is erased by the main eraser 10.

The paper feed assembly 28 has an openable manual feeder 39, a first paper cassette 29 and a second paper cassette 30. When inserted through the manual feeder 39, copy paper is transported to the timing roller pair 24 via a pair of manual feed rollers 31 and a pair of intermediate rollers 32. Sheets of copy paper within the first or second cassette 29 or 30 are sent out one by one by a first or second feed roller 33 or 34 and transported to the timing roller pair 24 via the intermediate roller pair 32.

The rollers 24, 31, 32, 33 and 34 are disconnectably coupled to a a drive system including the main motor, each by a clutch. When the clutch is engaged, the roller concerned is coupled to the drive system and driven by the motor.

Arranged in the vicinity of the cassettes 29, 30 are sensors 35, 36 for detecting the size of copy paper accommodated in the cassettes 29, 30, respectively, and empty cassette sensors 37, 38 for detecting the absence of paper in the cassettes 29, 30, respectively.

(Developing unit, see FIGS. 2 to 5).

The first developing unit 5 in the upper position is filled with a developer containing a monochromatic color toner, while the second developing unit 6 in the lower position is filled with a developer containing a black toner. When the developing unit selection key 124 or 125 to be described later is depressed, one of the developing units 5 and 6 is driven for producing monochromatic or back copy images. Furthermore, a plurality of units, which are different in color, are prepared each for use as the first developing unit 5. These units are interchangeable for use in the copying machine main body 1.

Figure 2:
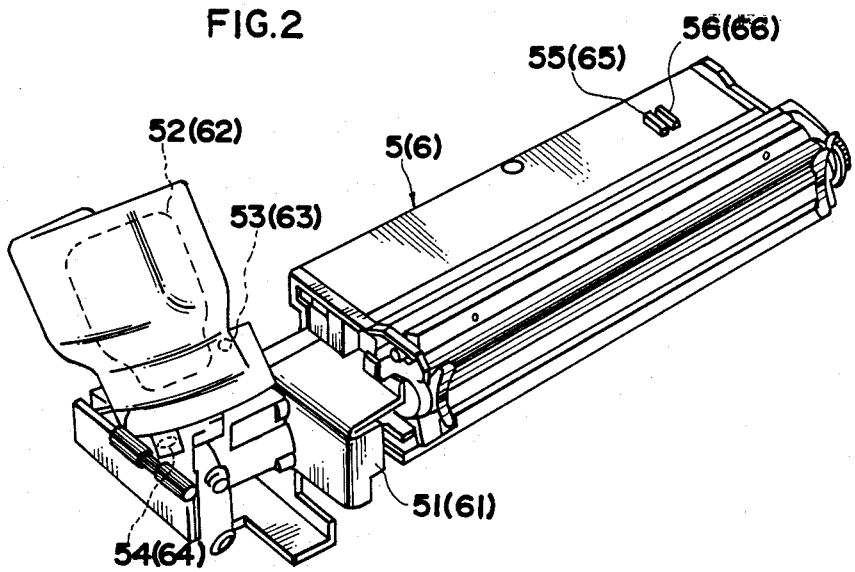
FIG. 2 is a perspective view of a developing unit.

First with reference to FIG. 2, the appearance of the developing units 5, 6 and the identification of colors will be described. Although FIG. 2 shows the first developing unit 5 as an example, the second developing unit 6 has a similar construction, with each part thereof designated by the corresponding reference number in parentheses in FIG. 2.

The developing unit 5 (6) has attached to lengthwise one end thereof a bracket 51 (61), to which a toner replenishing bottle 52 (62) is removably attached. The toner within the bottle 52 (62) is supplied to a developing tank by unillustrated toner supply means in response to a toner supply signal. The bracket 51 (61) is provided with a sensor 53 (63) positioned close to the bottle 52 (62) for detecting the presence or absence of the bottle, and with a sensor 54 (64) positioned close to the toner supply opening for detecting the bottle when it becomes empty. The sensor 53 (63) remains on while the bottle 52 (62) is installed in place but is turned off when it is removed. The sensor 54 (64) remains on while the toner remains in the bottle 52 (62) but is turned off when it becomes empty.

Magents 55, 56 (65, 66) can be attached to the upper side of the developing unit 5 (6). Positioned in corresponding relation to the magnets are first and second reed switches 57, 58 (67, 68) attached to the main body 1. The on-off combinations of these reed switches make it possible to identify the colors of toners as listed below.

| lst Switch 57 (67) | 2nd Switch 58 (68) | Color of toner |
|---|---|---|
| ON | ON | Black |
| ON | OFF | Red |
| OFF | ON | Yellow |
| OFF | OFF | Blue |

Figure 3:
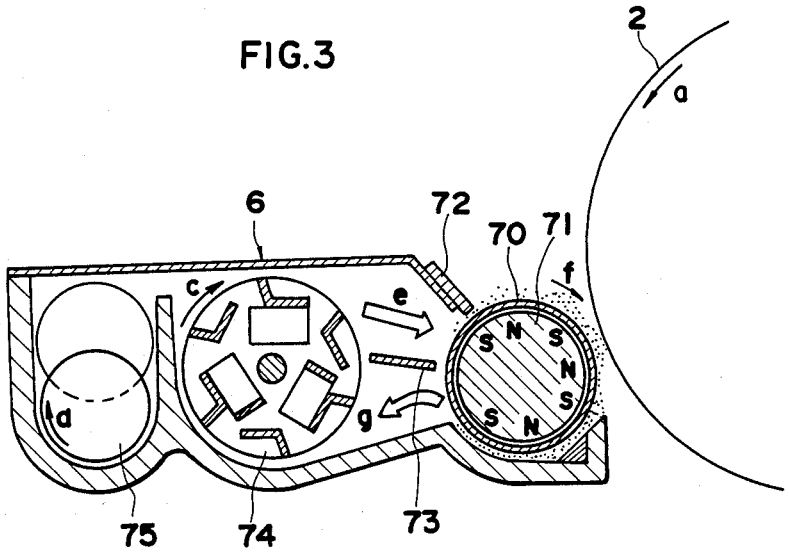
FIGS. 3 and 4 are sectional views showing the interior of the developing unit.

The interior construction of the second developing unit 6 will now be described with reference to FIGS. 3 and 4. The first developing unit 5, which will not be described, has substantially the same interior construction as the second except that it does not have the shutter 73 to be described below.

The developing unit 6 has a developing sleeve 70 opposed to the photosensitive drum 2, and a magnet roller 71 housed in the sleeve 70 and having N and S seven poles along its outer periphery. The rear portion of the magnet roller 71 away from the drum 2 has no magnetism or a weak magnetic force. A bucket roller 74 and a screw roller 75 are arranged in the rear of the developing sleeve 70, with a shutter 73 interposed between the sleeve and the roller 74. The rollers 74, 75 are drivingly rotatable in the direction of arrows c, d, respectively. The developer is circulated by the rollers 74, 75, and the screw roller 75 is replenished with the toner from the bottle 62. The developer is passed over the shutter 73 in the direction of arrow e, supplied to the developing sleeve 70, transported in the direction of arrow f owing to the rotation of the sleeve 70 itself in the same direction while being attracted in the form of a brush to the outer peripheral sleeve surface and brought into rubbing contact with the drum surface at a developing station for development. The developer thereafter moves off the sleeve surface at the rear portion of the magnet roller 71 where the roller 71 has low or no magnetism, and is returned to the bucket roller 74 toward the direction of arrow g.

The present copying machine includes the developing units 5, 6 which are arranged side by side and one of which is selectively operable. When one of the developing units, especially the first developing unit 5, of such apparatus is selected for use in developing operation, the developer on the outer periphery of the sleeve 70 of the other developing unit 6 must be held out of contact with the surface of the drum 2 to obviate the undesired deposition of the toner and to preclude the developer of the second unit 6 in the lower position from disturbing the toner image formed by the first unit 5.

Figure 4:
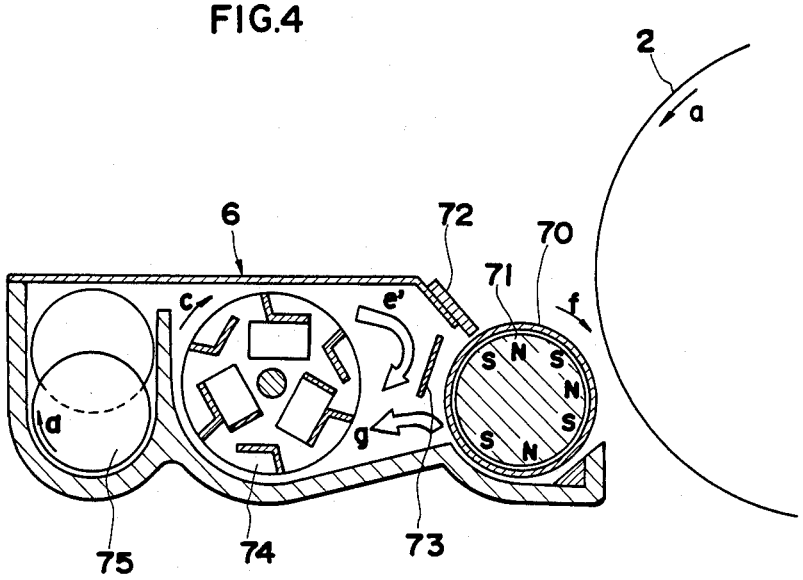

When the first developing unit 5 of the present embodiment is selected, therefore, the shutter 73 of the second unit 6 unnecessary for development is turned to an approximately vertical position as shown in FIG. 4, and the developing sleeve 70 is driven for a short period of time, whereby the developer from the bucket roller 74 is returned by the shutter 73 toward the direction of arrow e' without being supplied to the sleeve 70. The developer portion remaining on the sleeve surface is forced toward the direction of arrow g by the rotation of the sleeve and is collected by the bucket roller 74. Consequently, no developer remains on the surface of the sleeve 70, permitting the latent image or toner image to pass through the developing station of the second unit free of any adverse influence.

Figure 5:
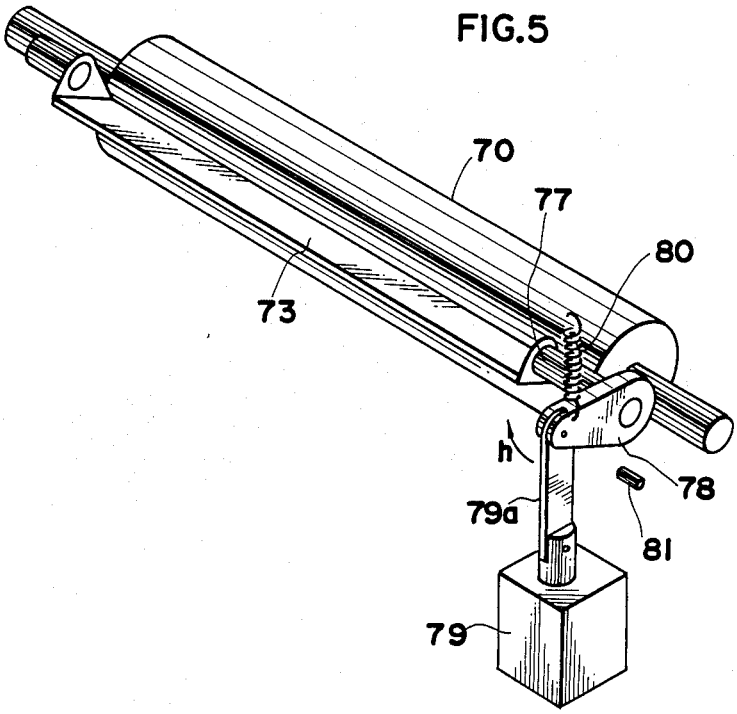
FIG. 5 is a perspective view of a shutter shift mechanism.

FIG. 5 shows a mechanism for shifting the shutter 73. The shifting mechanism comprises a lever 78 fixed to a pivot 77 for the shutter 73, a solenoid 79 with a plunger 79*a* connected to the lever 78, and a coiled spring 80 biasing the lever 78 in the direction of arrow h. Usually, the solenoid is held unenergized, and the lever 78 is biased toward the direction h by the spring 80 to position the shutter 73 approximately horizontally as shown in FIG. 3. When the first developing unit 5 is selected, the solenoid 79 is energized, with the sleeve 70 in rotation in the direction of arrow f, retracting the plunger 79*a* and turning the lever 78 in a direction opposite to the arrow h until the lever comes into contact with a stopper 81 to position the shutter 73 approximately vertically as seen in FIG. 4. Consequently, the developer is removed from the outer peripheral surface of the developing sleeve 70 as already described. Subsequently, the sleeve 70 is stopped, and the solenoid 79 is deenergized, returning the shutter 73 to the initial generally horizontal position. With the sleeve 70 held out of rotation, there is no likelihood that some developer will remain on the sleeve surface.

When the second developing unit 6 is selected, the developing sleeve 70 is driven as it is, whereby the developer is supplied as transported on the sleeve surface to the developing station.

According to the present embodiment, it is only the second developing unit 6 that is equipped with the means for bringing the developer away from the developing station by the shutter 73. The first developing unit 5 is so controlled as to alter the developing bias voltage to be applied to the developing sleeve instead of employing the shutter 73 for discontinuing the supply of the developer. To prevent fogging with toner, the developing bias voltage applied to the developing sleeve generally has a polarity opposite to the polarity of the charge on the toner. In this case a higher developing bias voltage is applied to the sleeve than when the first unit is selected. The toner is then effectively attracted to the developing sleeve without the likelihood of adhering to the latent image passing through the developing station. Since the second developing unit 6 uses the black toner in the case of the present embodiment, the first developing unit 5 which uses a monochromatic toner is merely so controlled as stated above, and yet black toner images can be obtained actually almost free of any adverse effect.

Further according to the present embodiment, the depression of the key 124 or 125 on a control panel 100 renders the developing unit 5 or 6 selectable, even during copying operation, for the subsequent copying When the selection is thus accepted, auto-resetting of the developing unit input is prohibited or delayed. Consequently, even if the next user fails to promptly make preparations for his copies, at least the time required for selecting the developing unit 5 or 6 can be saved. The control process for this purpose will be described in detail later with reference to the flow charts concerned.

Figure 6:
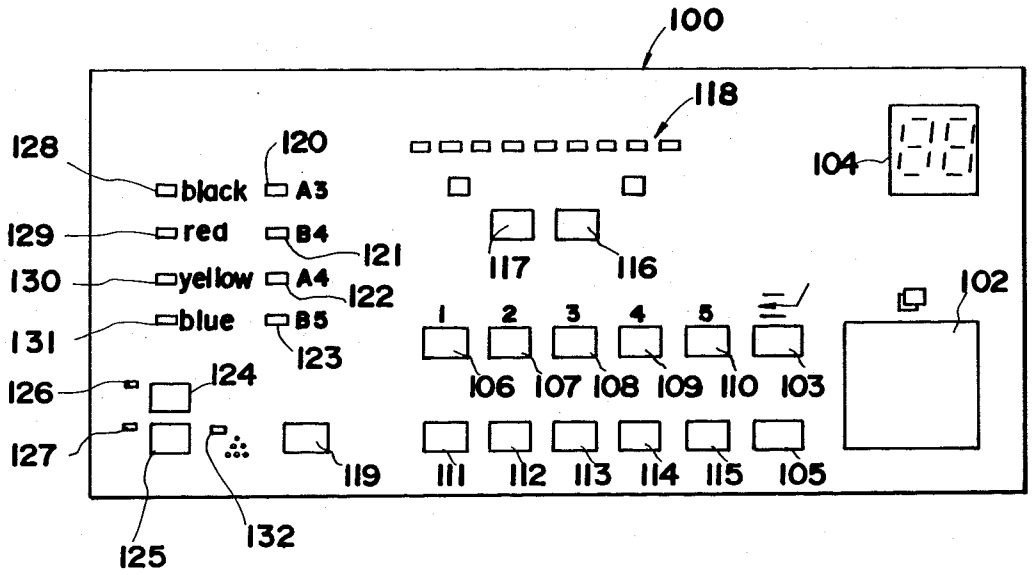
FIG. 6 is a plan view of an operation panel.

(Operation panel, see FIG. 6)

The operation panel is provided on the top of the copying machine main body 1 and has a print key 102, interrupt key 103, display 104 for showing the number of copies to be made and trouble codes, clear/stop key 105 for discontinuing copying operation immediately after the start thereof or during multicopying operation (for making a plurality of copies continually from a document) and for returning the copy number indicated on the display 104 to the standard mode, i.e. "1", number entry keys 106 to 115 for setting the copy number on the display 104, exposure up key 116 and exposure down key 117 for giving an adjusted image density by increasing or decreasing the amount of exposure by the light source 12, LEDs 118 to be selectively turned on or indicating the amount of exposure (image density), paper size (paper feeder) selection key 119, LEDs 120 to 123 for indicating the selected paper size, developing unit selectio keys 124, 125 for selecting the first unit 5 or second unit 6, LEDs 126, 127 for indicating the selected unit 5 or 6, LEDs 128 to 131 for indicating the color of the toner in the selected unit 5 or 6, and LED 132 for representing the absence of toner in the toner replenishing bottle 52 or 62 on the selected developing unit 5 or 6.

Figure 7:
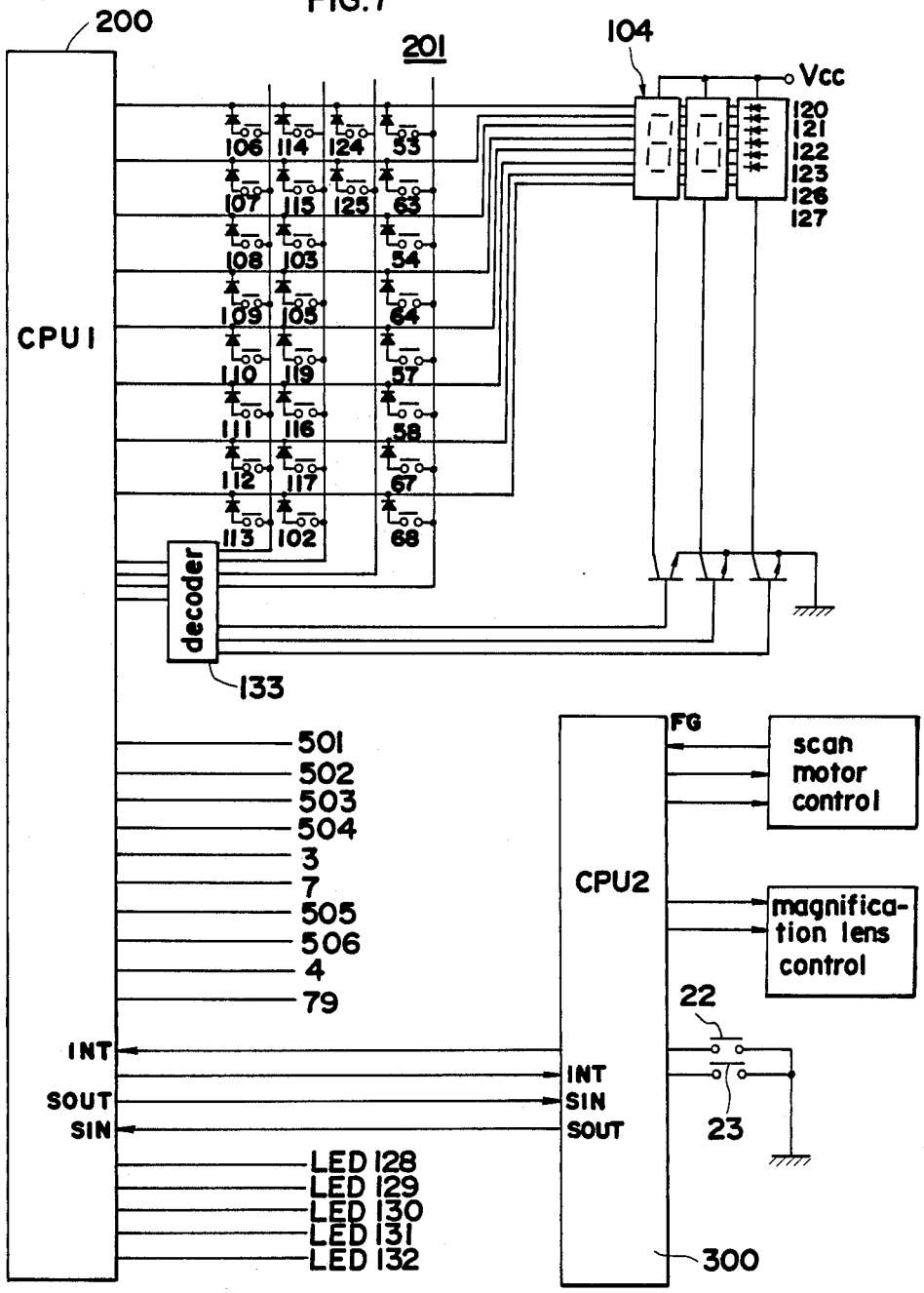
FIG. 7 is a control circuit diagram.

(Constrol circuit, see FIG. 7)

The control circuit for the copying machine of the foregoing construction comprises the first CPU 200 which is the main component, and a second CPU 300 for controlling the optical system 11. Connecting to the first CPU 200 is a switch matrix 201 including various keys on the operation panel 100, tonner bottle sensors 53, 63, toner absence sensors 54, 64, reed switches 57, 58, 67, 68 for detecting the colors of toners, etc. which are arranged in rows and columns. In response to the depression of keys and operation of sensors, the first CPU 200 controls main motor 501, timing roller clutch 502, first feed roller clutch 503, second feed roller clutch 504, sensitizing charger 3, transfer charger 7, first developing motor 505, second developing motor 506, inter-image eraser 4, shutter solenoid 79, etc. Further the display 104 and the LEDs are on-off controlled by the first CPU via the matrix 201 and a decoder 133.

On the other hand, the second CPU 300 has connected thereto the home position switch 22, timing switch 23 and control circuits for the scanning motor and the lens 18 and is connected to the first CPU 200 for synchronized operation.

(Control process, see FIGS. 8 to 11)

Figure 8:
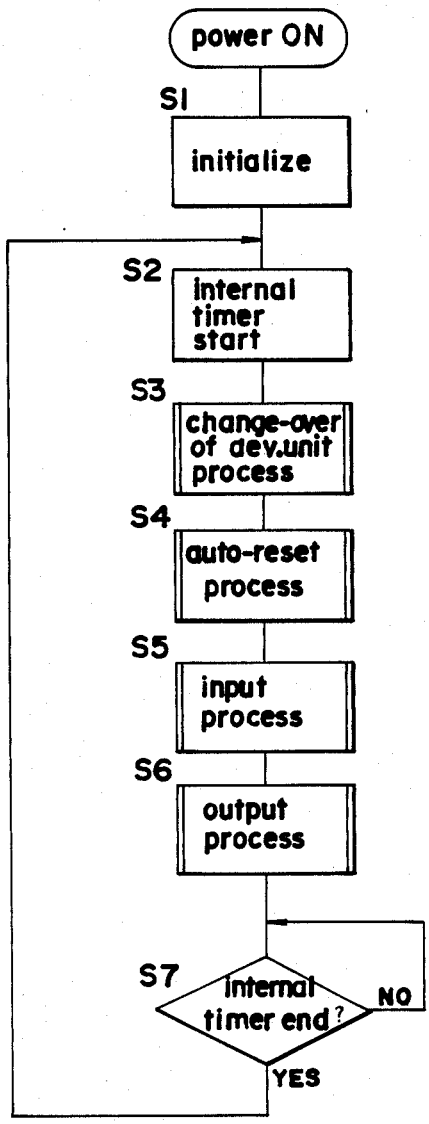
FIG. 8 is a flow chart showing the main routine for the copying machine.

FIG. 8 shows the main routine to be performed by the first CPU 200.

When the first CPU 200 is reset for starting the program, Step S1 is performed for initialization, clearing the random access memory, initializing various registers and setting component devices in the initial mode. An internal timer for determining the time required for the main routine is then started in Step S2. The time value is preset by the initialization of Step S1.

Subsequently, the subroutines are called in succession in steps S3 to S6, and after the completion of all the subroutines, the sequence returns to step S2 on completion of the operation of the internal timer. Using the time interval of one routine, various timers perform counting operation during the subroutine.

Step S3 is a change-over subroutine which is performed for the selected developing unit 5 or 6. Step S4 is the auto-reset subroutine to be performed after the completion of copying operation. These steps will be described in detail below. Step S5 is a copying operation setting subroutine which is performed in accordance with inputs from the operation panel 100. Step S6 is a subroutine for producing output signals for controlling various devices to conduct a copying operation. The subroutines of Steps S5 and S6 are known and therefore will not be described.

Figure 9:
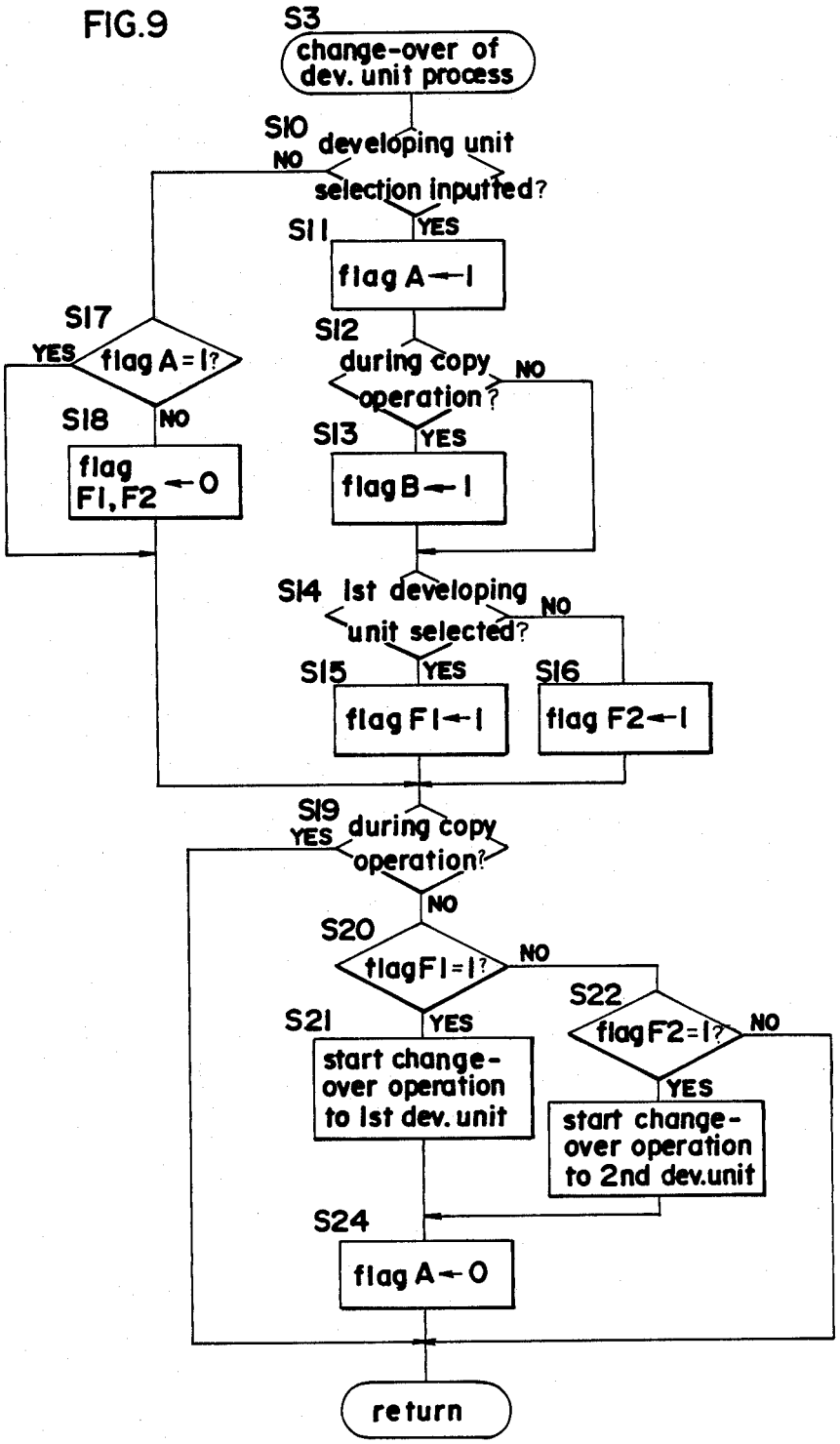
FIG. 9 is a flow chart showing a developing unit change-over subroutine.

FIG. 9 shows the developing unit change-over subroutine to be executed in Step S3 of the main routine.

First, Step S10 inquires whether a developing unit selecting input has been given. When the answer is affirmative, Step S11 sets a flag A to "1", indicating that the selecting input has been entered. Step S12 then inquires if the machine is in copying operation. If the answer is affirmative, a flab B is set to "1" in Step S13. The flag B, when "1", indicates that the developing unit selecting input has been given during copying operation.

Next, Step S14 inquires whether the selected unit is the first developing unit 5. If the answer is affirmative, a flag F1 is set to "1" in Step S15, showing the unit 5 as selected. Step S19 then follows. If the second unit 6 is found selected, the inquiry of Step S14 is answered in the negative. A flag F2 is set to "1" in Step S16, indicating that the second unit 6 has been selected. The sequence then proceeds to Step S19.

On the other hand, if no developing unit is found to be selected in Step S10, Step S17 checks whether the flag A is "1". If it is "1", Step S19 directly follows. If otherwise, the flags F1 and F2 are reset to "0" in Step S18, followed by Step S19.

Step S19 checks whether the machine is currently in copying operation. When it is in operation, the sequence returns to the main routine. If otherwise, Steps S20 and S22 are performed to check whether the flags F1 and F2 are "1". When the flag F1 is found to be "1" in Step S20, Step S21 starts a change-over to the first unit 5. The flag A is reset to "0" in Step S24, whereby the subroutine is completed. If the flag F2 is found to be "1" in Step S22, Step S23 starts a changeover to the second unit 6, followed by Step S24 to complete the present subroutine.

Figure 10:
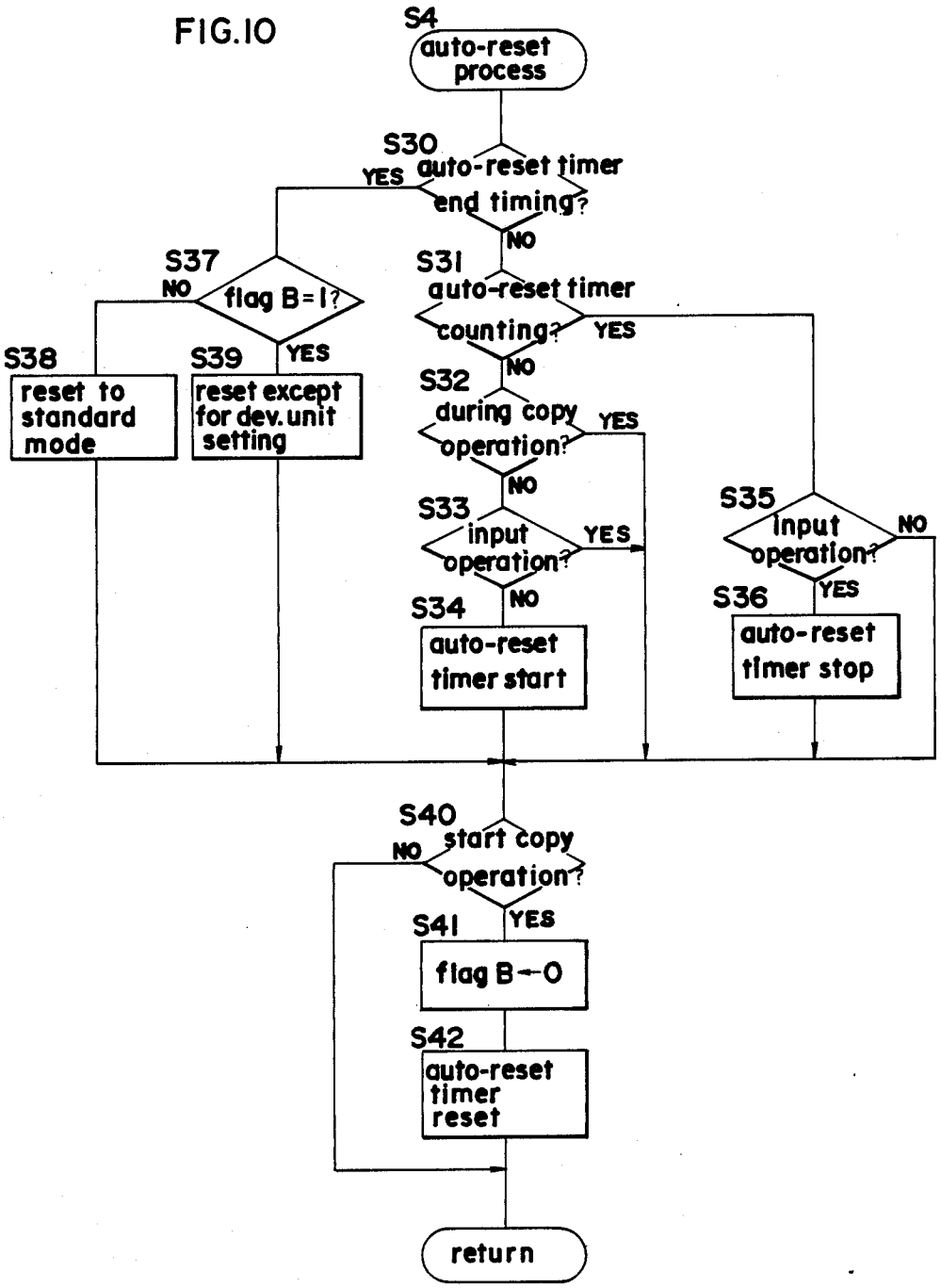
FIG. 10 is a flow chart showing an auto-reset subroutine.

FIG. 10 shows the auto-reset subroutine to be executed in Step S4 of the main routine.

When no input is given via the operation panel 100 after the completion of copying operation and until the completion of operation of an auto-reset timer, the copying machine is changed from the copy mode to the standard mode in this subroutine so as to obviate errors by the next user. The items to be auto-reset include the image density, magnification, copy number and developing unit settings. As to the developing unit, auto-resetting may be prohibited as an exceptional case.

Step S30 inquires whether the operation of the auto-reset timer is complete. When the answer is affirmative, Step S37 follows. If it is in the negative, Step S31 checks the auto-reset timer as to whether it is counting. Since the auto-reset timer is started in Step S34, the inquiries of Steps S30 and S31 are answered in the negative, and Step S32 checks whether the machine is in copying operation. If it is in operation, Step S40 follows. If otherwise, Step S33 checks whether an input is given via the operation panel 100. When the answer is affirmative, Step S40 follows. If otherwise, the auto-reset timer is started in Step S34. The sequence then proceeds to Step S40.

When the inquiry of Step S31 is answered in the affirmative with the auto-reset timer in counting operation, Step S35 inquires if there is an input from the operation panel 100. When the answer is negative, Step S40 follows. If it is affirmative, the auto-reset timer is stopped in Step S36, which is followed by Step S40.

On the other hand, if the auto-reset timer produces a completion signal in the absence of input, the inquiry of Step S30 is answered in the affirmative, followed by Step S37, which checks the flag B as to whether it is "1". As already stated, this flag B is set to "1" in Step S13 if a developing unit selecting signal input is given during copying operation. When the flag B is found to be "1", the copy mode except for the developing unit setting is returned to the standard mode in Step S39, followed by Step S40. In this way, despite the completion of auto-reset timer operation, auto-resetting of the developing unit selecting input accepted during copying operation is prohibited. On the other hand, if the flag B is "0", the copy mode is entirely returned to the standard mode in Step S38, and the sequence proceeds to Step S40.

Step S40 inquires whether the machine has been initiated into copying operation. If the answer is in the negative, the sequence returns to the main routine. When the machine is already in operation, the flag B is reset to "0" in Step S41. In Step S42, the auto-reset timer is reset to complete the subroutine.

Figure 11:
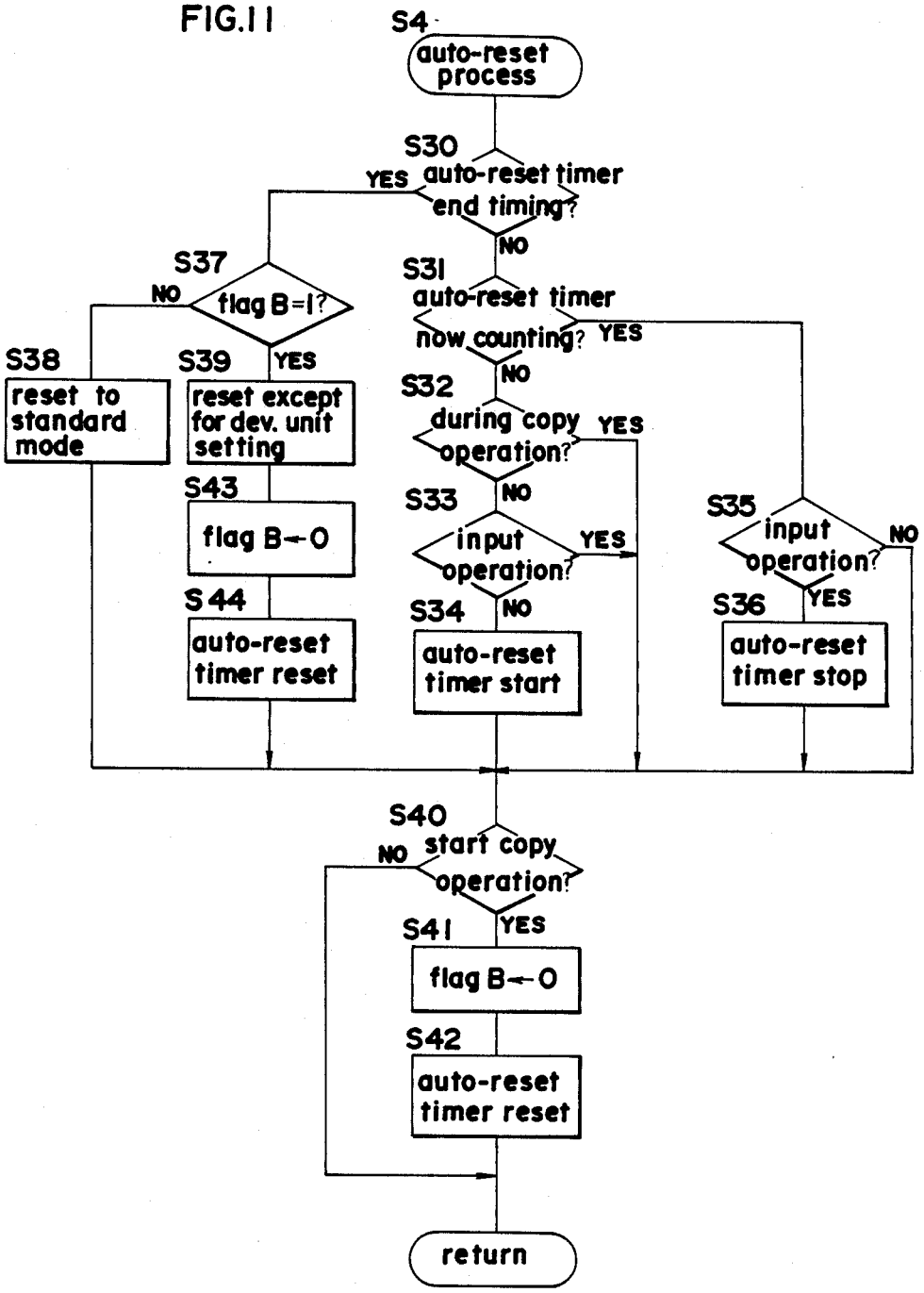
FIG. 11 is a flow chart showing a modified auto-reset subroutine.

FIG. 11 shows a modification of the auto-reset subroutine. The modified subroutine is the same as the subroutine of FIG. 10 except that Step S39 is followed by Steps S43 and S44.

When the machine is returned to the standard mode except for the developing unit setting in Step S39, with the unit selecting input given during copying operation, the flag B is reset to "0" in Step S43, and the auto-reset timer is reset in Step S44. Consequently, when no input is entered by the operation panel 100, the auto-reset timer is started again in Step S34. After a timer operation completion signal is given, the inquiry of Step S37 is answered in the negative. It is in Step S38 that the developing unit setting is auto-reset.

With the modified subroutine, therefore, the developing unit selecting input is auto-reset upon lapse of two times the time interval of the foregoing case.

The selection input auto-resetting may be delayed similarly using a different timer.

Although the developing unit only can be selected by an advance input according to the present embodiment, other modes, various elements, etc. of the image forming apparatus may be made selectable by advance inputs. A second embodiment will be described below wherein not only the developing unit but also the paper cassette is selectable by an advance input.

This embodiment, i.e. copying machine, is similar to the first embodiment in overall construction and operation, and in respect of the developing units.

Figure 12:
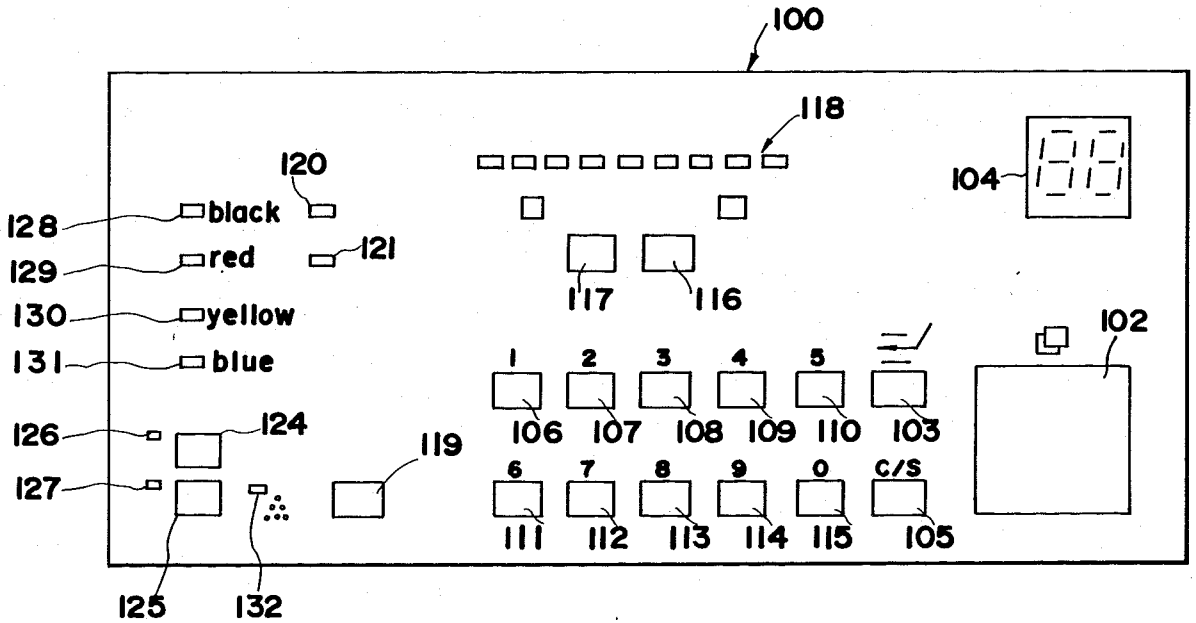
FIG. 12 is a plan view of an operation panel included in a second embodiment of the invention.

FIG. 12 shows the operation panel of the second embodiment, which is the same as the one shown in FIG. 6 except that the paper size (feeder) selection key 119 and the paper size display LEDs 120 to 123 of the first embodiment are replaced by a paper feeder selection key 119A, and a first feed unit display LED 120A and a second feed unit display LED 121A for indicating the selected paper feeder.

Figure 13:
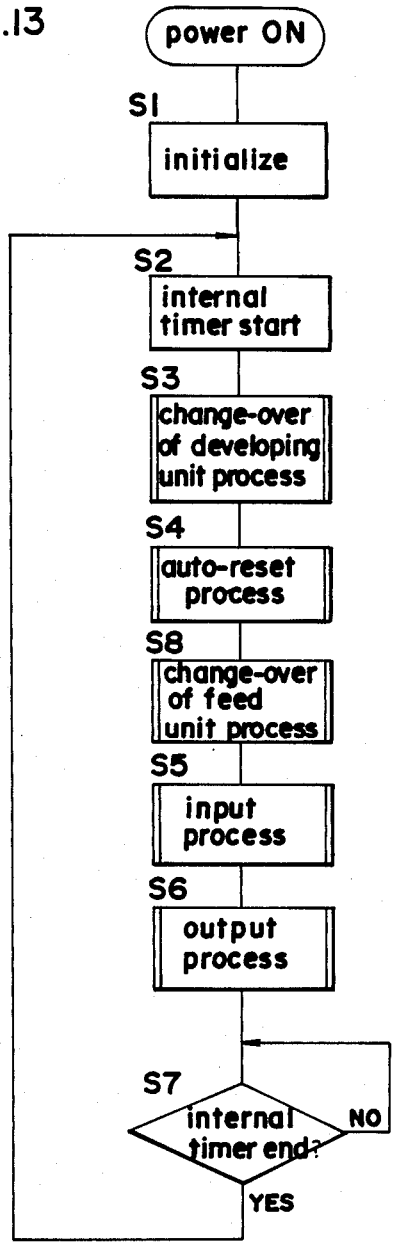
FIG. 13 is a flow chart showing the main routine for the second embodiment.

The control process will be described next. FIG. 13 shows the main routine which is the same as the main routine (FIG. 8) of the first embodiment except the routine of FIG. 13 further includes Step S8 which is a subroutine for a change-over between the paper feed units 29 and 30 to use the selected one.

Figure 14:
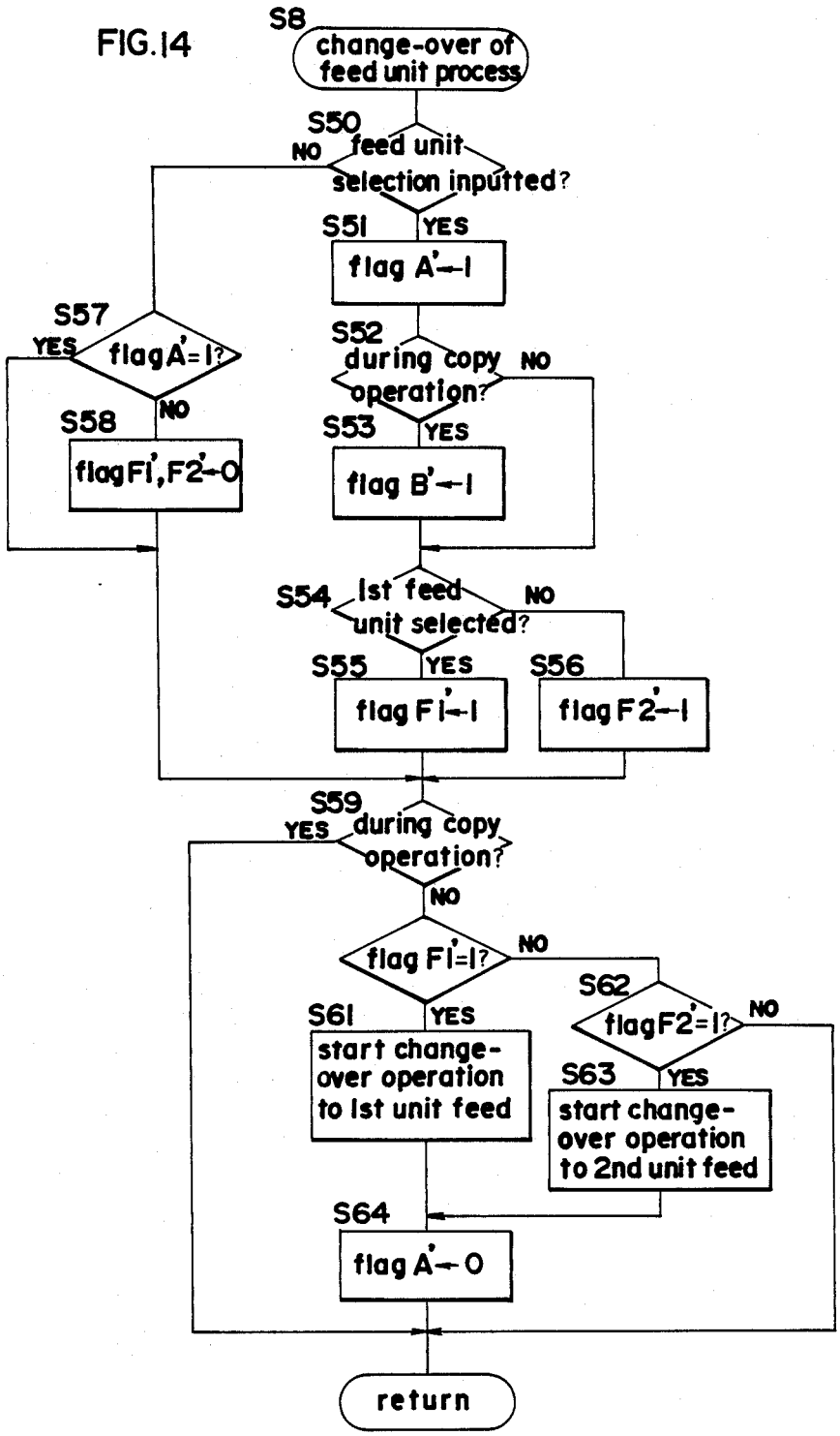
FIG. 14 is a flow chart showing a paper cassette change-over subroutine for the same.

Step S3, a developing unit change-over subroutine, for the second embodiment is the same as the corresponding step shown in FIG. 9. The paper feed unit change-over subroutine to be performed in Step S8 is shown in FIG. 14.

First, Step S50' inquires whether a feed unit selecting input has been given. When the answer is affirmative, Step S51' sets a flag A' to "1", indicating that the selecting input has been entered. Step S52' then inquires whether the machine is in copying operation. If the answer is affirmative, a flag B' is set to "1" in Step S53'. This flag B', when "1", indicates that the feed unit selecting input has been given during copying operation.

Next, Step S54' inquires whether the selected unit is the first feed unit 29. If the answer is affirmative, a flag F1' is set to "1" in Step S55', indicating the unit 29 as selected. Step S59' then follows. If the second feed unit 30 is found selected, the inquiry of Step S54' is answered in the negative. A flag F2' is set to "1" in Step S56', indicating that the second unit 30 has been selected. The sequence then proceeds to Step S59'.

On the other hand, if no feed unit is found to be selected in Step S50', Step S57' checks whether the flag A' is "1". If it is "1", Step S59' directly follows. If otherwise, the flags F1' and F2' are reset to "0" in Step S58', followed by Step S59'.

Step S59' checks whether the machine is currently in copying operation. When it is in operation, the sequence returns to the main routine. If otherwise, Steps S60' and S62' are performed to check whether the flags F1' and F2' are "1". When the flag F1' is found to be "1" in Step S60', Step S61' starts a change-over to the first feed unit 29. The flag A' is reset to "0" in Step S64', whereby the subroutine is completed. If the flag F2' is found to be "1" in Step S62', Step S63' starts a change-over to the second unit 30, followed by Step S64'to complete the subroutine.

Figure 15A:
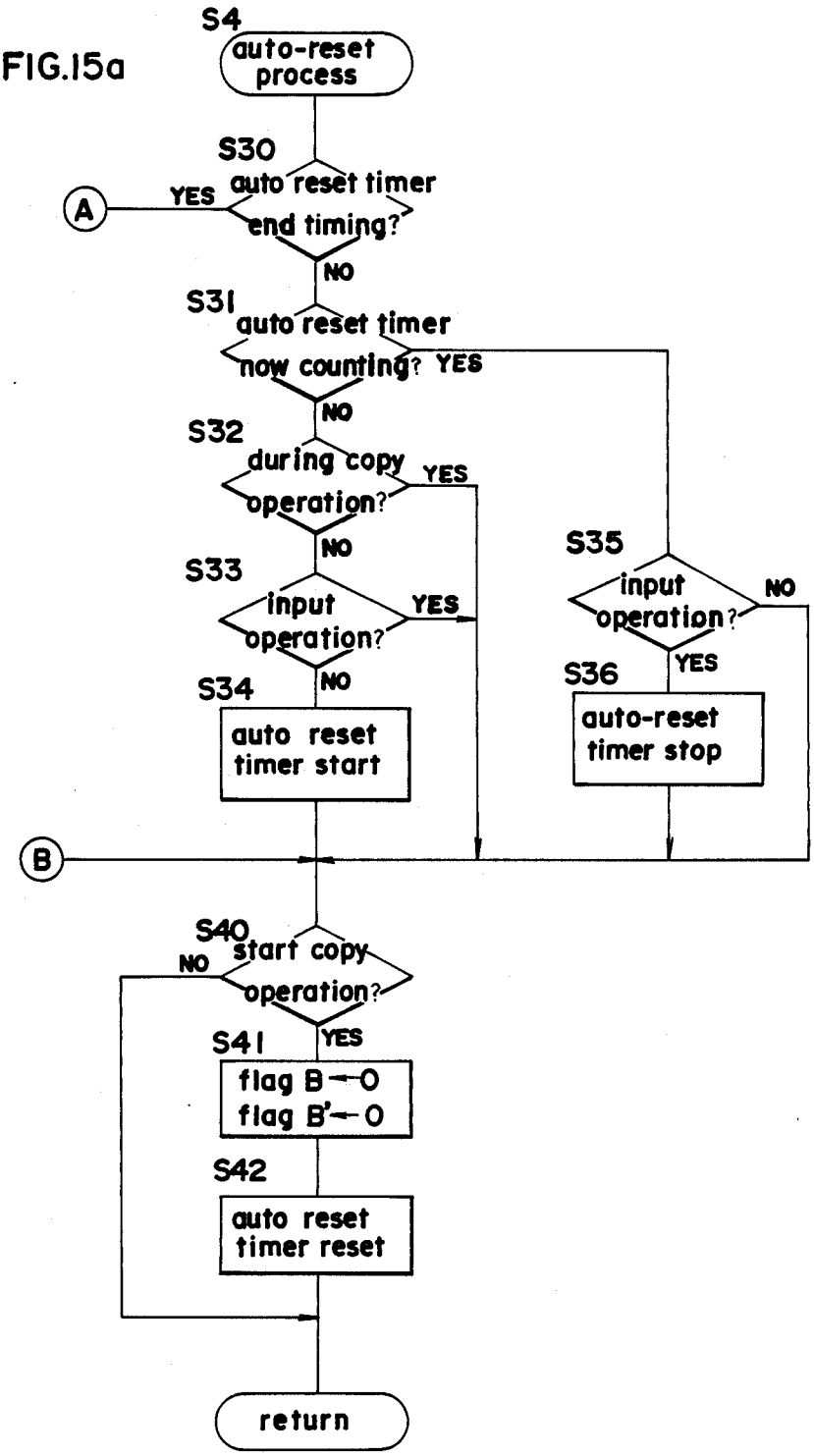
FIG. 15 is a flow chart showing an auto-reset subroutine for the same.
Figure 15B:
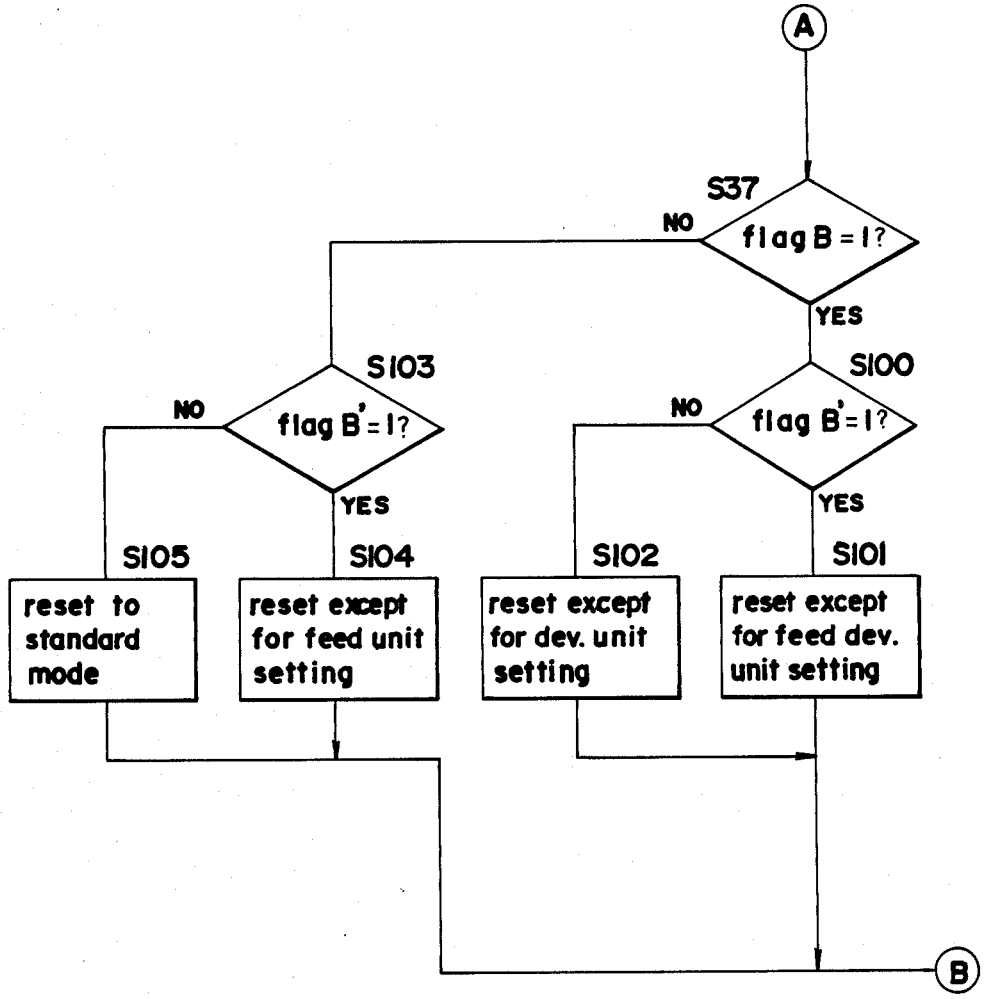

FIG. 15 shows the auto-reset subroutine to be performed in Step S4 of the main routine. This subroutine is similar to the subroutine of FIG. 10 with the exception of the following steps. Step S37 checks whether the flag B is "1". If it is "1", Step S100 checks whether the flag B' is "1". As already stated, when a feed unit selecting input is given during copying operation, this flag B' is set to "1" in Step S53'. When the flag is found to be "1", the copy mode is returned to the standard mode except for the developing unit setting and the feed unit setting in Step S101. The sequence the proceeds to Step S40.

When the inquiry of Step S100 is answered in the negative, the copy mode is returned to the standard mode except for the developing unit setting in Step S102, which is followed by Step S40.

When Step S37 finds that the flag B is not "1", Step S103 checks whether the flag B' is "1". If it is "1", the copy mode is returned to the standard mode except for the feed unit setting in Step S104. The sequence then returns to Step S40. If the answer to the inquiry of Step S103 is in the negative, the copy mode is entirely returned to the standard mode in Step S105.

Figure 16A:
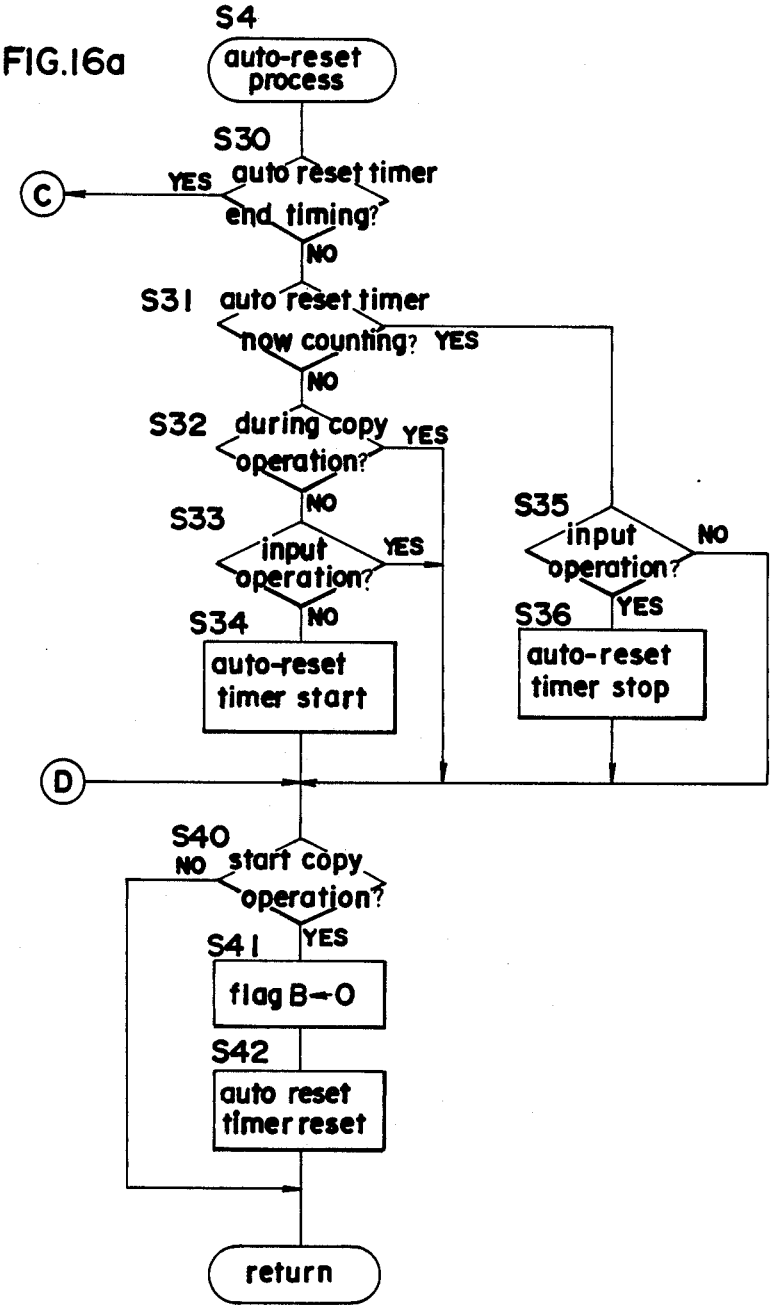
FIG. 16 is a flow chart showing a modification of the subroutine of FIG. 15.
Figure 16B:
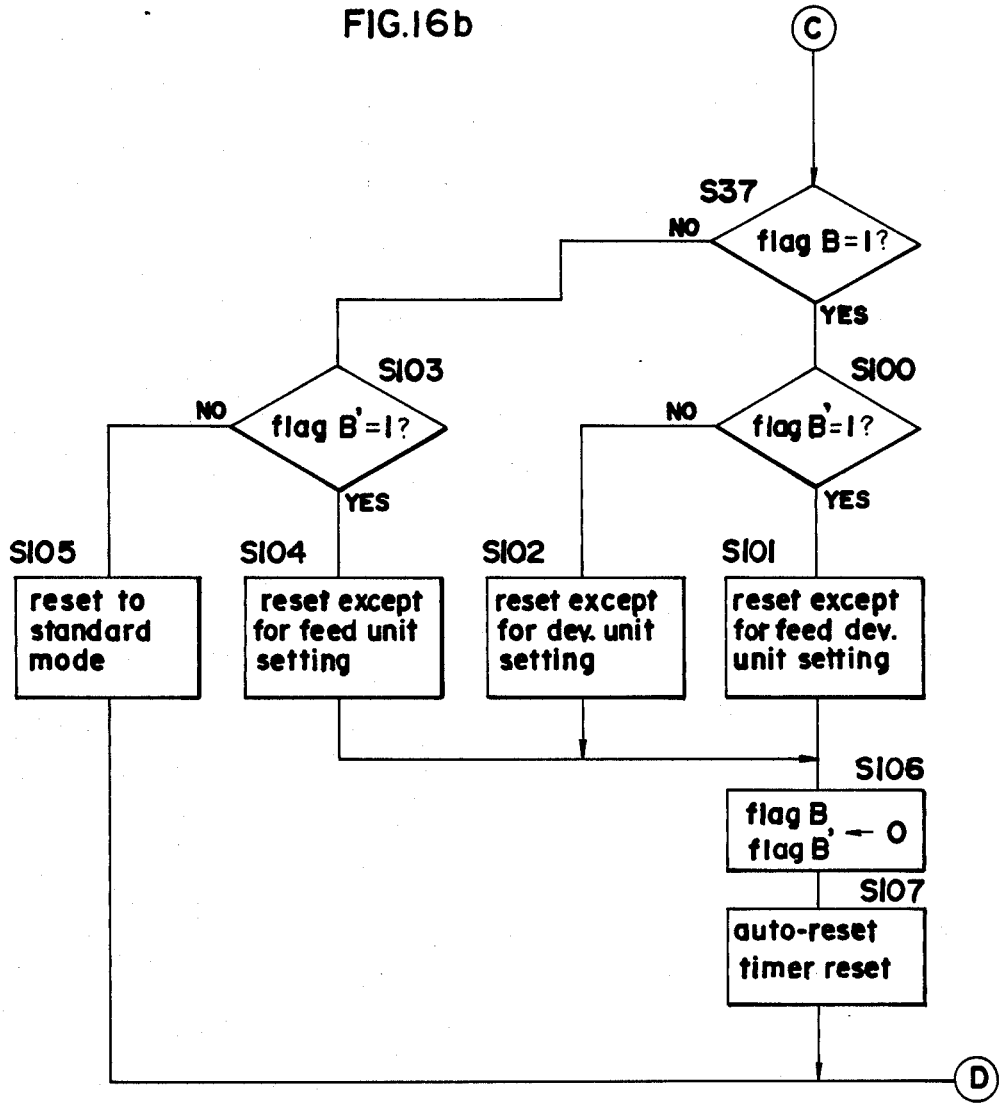

FIG. 16 shows a modification of the auto-reset subroutine of the second embodiment. The modified subroutine is the same as the subroutine of FIG. 15 except that Steps S101, S102 and S104 are followed by Steps S106 and S107.

With a developing unit or feed unit selecting input accepted during copying operation, Step S101 returns the copy mode to the standard mode except for the developing unit setting and the feed unit setting, or Step S102 returns the copy mode to the standard mode except for the developing unit setting, or Step S104 returns the copy mode to the standard mode except for the feed unit setting, the flag B and/or B' is then reset to "0" in Step S106. and the auto-reset timer is reset in Step S107. Consequently, when no input is entered by the operation panel 100, the auto-reset timer is started again in Step S34. After a timer operation completion signal is given, the inquiry of Step S37 is answered in the negative. It is in Step S105 that the developing unit or feed unit setting is auto-reset.

With the modified subroutine, therefore, the developing unit or feed unit selecting input is autoreset upon lapse of two times the time interval of the foregoing case.

Futhermore, the present invention can be embodied for the selection of the paper feeder in advance. For example, during copying operation with use of the first feeder 29, the next user specifies the second feeder 30 with an advance input by depressing the feeder selection key 119A on the operation panel of FIG. 12. In this case, the auto-resetting of the advance input for the second feeder is prohibited or delayed.

The above feeder selection is executed according to the subroutine of FIG. 14. Further the flag B' is checked as to whether it is "1" in Step S37 of FIGS. 10 or 11, and depending on the state of the flag, Step S39 returns the copy mode to the standard mode except for the feed unit setting, whereby the auto-resetting of the feed unit setting is prohibited or delayed.

The present invention can be embodied similarly for setting the magnification, the number of copies, etc. The desired value may be specified by an advance input for only one of these items as in the first embodiment or for more than one of these items as in the case of the second embodiment.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus capable of executing a copying operation by combining a plurality of copying conditions inclusive of at least a standard condition and a condition different from the standard condition comprising:

input means for inputting any one of conditions different from the standard condition;

reset means for automatically returning the condition inputted by the input means to the standard condition after a lapse of predetermined time after the copying operation;

first control means for allowing the input by the input means during the copying operation;

second control means for at least prohibiting the reset means from automatically returning the condition inputted by the input means to the standard condition or extending the predetermined time for automatically returning the condition inputted by the input means to the standard condition when the input by the input means is allowed during the copying operation.

2. An image forming apparatus including image exposure means for projecting a document image on the surface of an electrostatic latent image bearing member to form an electrostatic latent image on the surface, developing means for developing the latent image and transfer means for transferring the developed image into a transfer material to obtain a copy image through an image forming operation, said image forming apparatus comprising:

first input means for designating a first copy mode under which the image forming operation is effected with at least one standard condition;

first image forming means for forming a copy image under the first copy mode designated by the first input means;

second input means for designating a second copy mode under which the image forming operation is effected with the condition different from said standard condition;

second image forming means for forming a copy image under the second copy mode designated by the second input means;

reset means for automatically returning the second copy mode to the first copy mode after a lapse of predetermined time after the image forming operation under the first copy mode;

first control means for entering the designation of the second copy mode by the second input means during the image forming operation under the first copy mode; and second control means for at least prohibiting the reset means from returning the second copy mode to the first copy mode or extending the predetermined time for automatically returning the second copy mode to the first copy mode when the designation of the second copy mode is entered during the image forming operation under the first copy mode.

3. An image forming apparatus as claimed in claim 2 wherein the developing means comprises at least a first developing unit and second developing unit different from the first developing unit, each of which is selectively operated.

4. An image forming apparatus as claimed in claim 3 wherein the first copy mode specifies the first developing unit to obtain a copy image developed by the first developing unit and the second copy mode specifies the second developing unit to obtain a copy image developed by the second developing unit.

5. An image forming apparatus as claimed in claim 2 further comprises a plurality of feeding sections for accommodating copy paper different in size.

6. An image forming apparatus as claimed in claim 5 wherein the first copy mode specifies a predetermined feeding section and the second copy mode specifies one of feeding sections different from the predetermined one.

7. An image forming apparatus including image exposure means for projecting a document image on the surface of an electrostatic latent image bearing member to form an electrostatic latent image on the surface, developing means selectively operated for developing the latent image, said developing means comprising at least a first developing unit and second developing unit, and transfer means for transferring the developing image onto a transfer material to obtain a copy image through an image forming operation, said image forming apparatus comprising:

first input means for designating the second developing unit so as to be selectively operated;

reset means for automatically returning the designation of the second developing means to that of the first developing unit after a lapse of predetermined time after the image forming operation;

first control means for allowing the input by the first input means during the image forming operation; and second control means for at least prohibiting the reset means from automatically returning the second developing unit to the first developing unit or extending the predetermined time for automatically returning the second developing unit to the first developing unit when the input by the first input means is allowed during the image forming operation.

8. An image forming apparatus as claimed in claim 7 further comprises a plurality of feeding sections for accommodating copy paper different in size and second input means for inputting one of the feeding sections.

9. An image forming apparatus as claimed in claim 8 wherein the reset means automatically returns the designation by the second input means to that of a predetermined feeding section after a lapse of predetermined time after the image forming operation.

10. An image forming apparatus as claimed in claim 9 wherein the first control means allows the designation by the second input means during the image forming operation.

11. An image forming apparatus as claimed in claim 10 wherein the second control means at least prohibits the reset means from automatically returning the designation by the second input means to the predetermined feeding section or extends the predetermined time for automatically returning the designation by the second input means to the predetermined feeding section when the input by the second input means is allowed during the image forming operation.

* * * * *